US011207706B2

(12) United States Patent
Hudd et al.

(10) Patent No.: US 11,207,706 B2
(45) Date of Patent: Dec. 28, 2021

(54) SYSTEM FOR APPLYING A MASKING MATERIAL TO A SUBSTRATE

(71) Applicant: Jetronica Limited, Blackburn (GB)

(72) Inventors: Alan Hudd, Blackburn (GB); Albert Kocsis, Blackburn (GB); Gusztav Florian, Blackburn (GB)

(73) Assignee: Jetronica Limited, Blackburn (GB)

( * ) Notice: Subject to any disclaimer, the term of this patent is extended or adjusted under 35 U.S.C. 154(b) by 183 days.

(21) Appl. No.: 16/486,446

(22) PCT Filed: Feb. 16, 2018

(86) PCT No.: PCT/GB2018/050414
§ 371 (c)(1),
(2) Date: Aug. 15, 2019

(87) PCT Pub. No.: WO2018/150190
PCT Pub. Date: Aug. 23, 2018

(65) Prior Publication Data

US 2021/0138498 A1 May 13, 2021

(30) Foreign Application Priority Data

Feb. 16, 2017 (GB) ..... 1702522

(51) Int. Cl.
*B05B 12/22* (2018.01)
*B05B 12/24* (2018.01)
(Continued)

(52) U.S. Cl.
CPC ..... *B05B 12/22* (2018.02); *B05B 12/24* (2018.02); *B05B 13/0447* (2013.01); *B05C 21/005* (2013.01)

(58) Field of Classification Search
USPC ..... 118/300, 301, 504, 505, 674, 699, 700, 118/679–682
See application file for complete search history.

(56) References Cited

U.S. PATENT DOCUMENTS 3,296,999 A 1/1967 Gamble
5,175,018 A 12/1992 Lee et al.
(Continued)

FOREIGN PATENT DOCUMENTS

JP H10-8233 A 1/1998
WO 2002007952 A2 4/2003
(Continued)

OTHER PUBLICATIONS

ISR/WO associated with parent application PCT/GB2018/050414 and dated Apr. 24, 2018.

*Primary Examiner* — Yewebdar T Tadesse
(74) *Attorney, Agent, or Firm* — Vorys, Sater, Seymour and Pease LLP

(57) ABSTRACT

Systems for applying a masking material to a substrate, the system comprising: a source feed for delivering a quantity of masking material to a substrate, a waste deposit for receiving masking material when removed from the substrate, a spray nozzle moveable relative to the substrate and a controller for controlling movement of the nozzle relative to the substrate and the speed of delivery of the masking material from the source feed, wherein the speed of movement of the spray nozzle relative to the substrate is substantially equal to the speed of delivery of the masking material from the source feed.

16 Claims, 4 Drawing Sheets

(51) Int. Cl.
*B05B 13/04* (2006.01)
*B05C 21/00* (2006.01)

(56) References Cited

U.S. PATENT DOCUMENTS

| | | | | |
|---|---|---|---|---|
| 6,482,264 | B1 * | 11/2002 | Sun | B01J 19/0046 118/300 |
| 2005/0136191 | A1 | 6/2005 | Vos et al. | |
| 2011/0162577 | A1 | 7/2011 | Margolies | |
| 2014/0329013 | A1 * | 11/2014 | Rouaud | B05D 1/36 427/282 |

FOREIGN PATENT DOCUMENTS

| | | | |
|---|---|---|---|
| WO | 2014203915 | A1 | 12/2014 |
| WO | 2018150193 | A1 | 2/2018 |

* cited by examiner

SYSTEM FOR APPLYING A MASKING MATERIAL TO A SUBSTRATE

FIELD

The present invention relates to a system for applying a masking material to a substrate particularly, but not exclusively for, a paint or print based application.

BACKGROUND

Many everyday objects such as automotive body panels, household appliances and children's toys are painted or printed by way of a spray based system. A typical spray based system comprises a nozzle that is co-operable with a reservoir containing a paint medium. A pump is used to drive the paint medium from the reservoir along a conduit to the nozzle where the paint is applied to a substrate. In most modern spray print systems, the position of the nozzle is accurately controlled by a computer based control system. The position of the nozzle can be adjusted through x, y, z co-ordinates and is typically accurate to within a very tight tolerance.

The paint medium in the reservoir is configured according to application. In an application where a smooth edge is required, the spatial configuration of the paint medium is such that the finish is homogenous. This is advantageous in most applications but the finish quality can be somewhat diminished where a sharp edge finish is required. To produce such a sharp edge finish, it is common for mask tape to be applied to the substrate. The substrate is then painted along with the mask tape. When the mask tape is removed a sharp edge finish is left behind on the substrate. This simple process has been used for many years but has certain drawbacks including: excess usage of paint, contamination of mask tape by paint, environmental concerns, potential damage to the paint finish when the mask tape is removed and cost of supplying the mask tape together with the labour required to apply the mask tape and remove after painting. In particular, as the used mask tape is contaminated with paint it cannot be re-used and it has to be disposed of into general landfill due to paint contamination. Used mask tape cannot be recycled.

The present invention seeks to address the aforementioned problems.

SUMMARY

According to an aspect of the invention, there is provided a system for applying a masking material to a substrate, the system comprising: a source feed for delivering a quantity of masking material to a substrate, a waste deposit for receiving masking material when removed from the substrate, a spray nozzle moveable relative to the substrate and a controller for controlling movement of the nozzle relative to the substrate and the speed of delivery of the masking material from the source feed, wherein the speed of movement of the spray nozzle relative to the substrate is configured to be substantially equal to the speed of delivery of the masking material from the source feed.

The described system removes the need for by-hand preparation of a substrate prior to painting thus saving significant time and expense. Furthermore, local environmental contamination is reduced as the masking material is sent straight to a waste deposit during the painting process and subsequently discarded at the end of the printing operation. Paint damage is also minimised as the masking material is removed from the substrate during the printing operation before the paint is dry. Once a roll of masking material is installed into the source feed, the masking operation is automated until such a time that the roll of masking material is depleted. At that time, a user simply has to dispose of the masking material in the waste deposit and install a new roll of masking material. This configuration enables the masking system to be used for multiple print operations between installation of new rolls of masking material.

The source feed, waste deposit and nozzle may define a spray unit moveable as a single unit.

Advantageously, movement of the source feed, waste deposit and roller as a single unit enables ease of alignment of the masking material with the nozzle during the painting operation.

The source feed may be in the form of a roller. The waste deposit may be in the form of a roller.

Use of a roller for the source feed and the waste deposit ensures that the speed at which the masking material leaves the source feed is equal to the speed at which the masking material arrives at the waste deposit. The risk of mechanical failure of either the source feed or the waste deposit is minimised due to the simple mechanical construction thereof.

The system may further comprise a guide for guiding the masking material between the source feed and the waste deposit.

Use of a guide ensures that the masking material is applied to the substrate in the desired manner without twisting or creasing.

The guide may be in the form of a pair of rollers between which the masking material passes.

The masking material may be a paper or plastic based material.

According to another aspect of the invention, there is provided a system for applying a masking material to a substrate, the system comprising: a source feed for delivering a continuous loop of masking material to a substrate, a spray nozzle moveable relative to the substrate for applying a paint medium to the substrate and a cleaner arranged to clean excess paint medium from the masking material.

Use of a continuous loop of masking material that passes through a cleaner has a significant positive environmental impact by removing the need to use non-recyclable paper based masking material that is contaminated with paint. Passing the continuous loop of masking material through a cleaner enables paint medium to be removed from the masking material such that the masking material is suitable for extended use without requiring replacement.

The speed of movement of the nozzle relative to the substrate may be equal to the speed of delivery of the masking material to the substrate.

The system may further comprise a guide for facilitating delivery of the masking material to the substrate.

The provision of a guide advantageously ensures that the masking material is applied to the substrate in the desired manner without twisting or creasing.

The guide may comprise a pair of rollers spaced apart to contact either side of the masking material.

The pair of rollers may be driven by a motor.

Use of a motor to drive the rollers enables the system to urge the masking material against the substrate thus deforming the masking material and more efficiently masking the surface and preventing paint medium from getting under the masking material. In combination with spring-like properties of the masking material, the motor provides that geometrical inaccuracies can be nullified by urging of the masking material against the substrate by the motor.

The system may further comprise angular adjustment means for modifying the angle of the source feed relative to the substrate.

The use of angular adjustment means provides that the masking material can be applied to the substrate in any orientation relative to the path of the nozzle.

The angular adjustment means may be configured to adjust the angle of the masking material such that the masking material is always applied to the substrate along the direction of travel of the nozzle.

To mask the substrate during painting in a curved direction the angular adjustment means can be configured such that the masking material is always applied to the substrate in the direction of travel of the nozzle. This also provides the further benefit of a higher quality paint finish in regions of the substrate where the nozzle follows a curved path.

The angular adjustment means may comprise a motor.

Use of a motor enables the angular adjustment means to respond quickly and in cooperation with a variation in the direction of travel of the nozzle.

The continuous loop of masking material may be formed from a plastic or metal material.

Use of a plastic or metal material enables the masking material to be cleaned without significant risk of damage to the masking material. A resilient material is important so that it is suitable for prolonged use without replacement.

The cleaner may comprise a reservoir and one or more wiping blades.

Provision of a reservoir enables collected paint medium to be stored for disposal or later re-use or the collected paint medium can be re-used during the current printing operation. Use of wiping blades efficiently removes wet paint medium from the masking material and causes the paint medium removed to pool in the reservoir.

The drain may comprise a drain for removal of paint material from the reservoir.

Provision of a drain enables paint within the reservoir to be easily removed from the reservoir and disposed of or fed back into the main print medium source.

The drain may comprise a valve having a closed position in which paint material cannot exit the reservoir and an open position in which paint material can exit the reservoir through the drain.

Provision of a valve enables a user to manually select when paint medium within the reservoir should be removed therefrom.

The reservoir may comprise a level sensor for detecting the level of paint medium within the reservoir and the valve may be controllable by a controller such that when the level of the paint medium within the reservoir is detected to have reached a pre-determined level by the level sensor the valve is moved to the open position to permit paint medium within the reservoir to drain therefrom.

The system may further comprise height adjustment means for adjusting the position of the continuous loop of masking material relative to the substrate in the y-dimension.

In some applications it may be advantageous for the masking material to be spaced apart from the substrate to be painted, i.e. the masking material defines a non-contact mask. This is particularly the case when a finished edge is not required to be sharp such as when painting the internal surface of a pattern.

The system may comprise two loops of continuous masking material, wherein the two loops are positioned on respective opposite sides of the nozzle.

An arrangement of two loops of masking material enables a paint system to accurately and efficiently spray paint a line or other narrow feature onto a substrate.

The two loops of continuous masking material may be delivered by a common source feed.

Each loop of continuous masking material may be delivered by respective source feeds.

FIGURES

The invention will now be described by way of reference to the following figures.

DESCRIPTION

Figure 1:
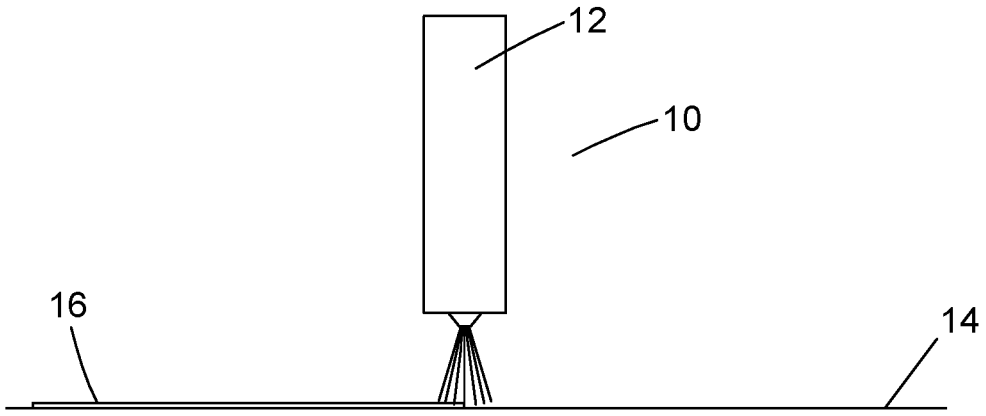
FIG. 1 illustrates a prior art method of spray painting a substrate.

A prior art paint spray system 10 is illustrated in FIG. 1. A nozzle 12 is arranged such that it is spaced apart from a substrate 14 to be painted. Masking material 16 is applied to the substrate 14 such that when paint is applied a sharp edge finish is possible. The masking material 16 is removed from the substrate following completion of the painting process. The masking material 16 is disposed of into general landfill due to being contaminated with paint thus preventing recycling.

Figure 2:
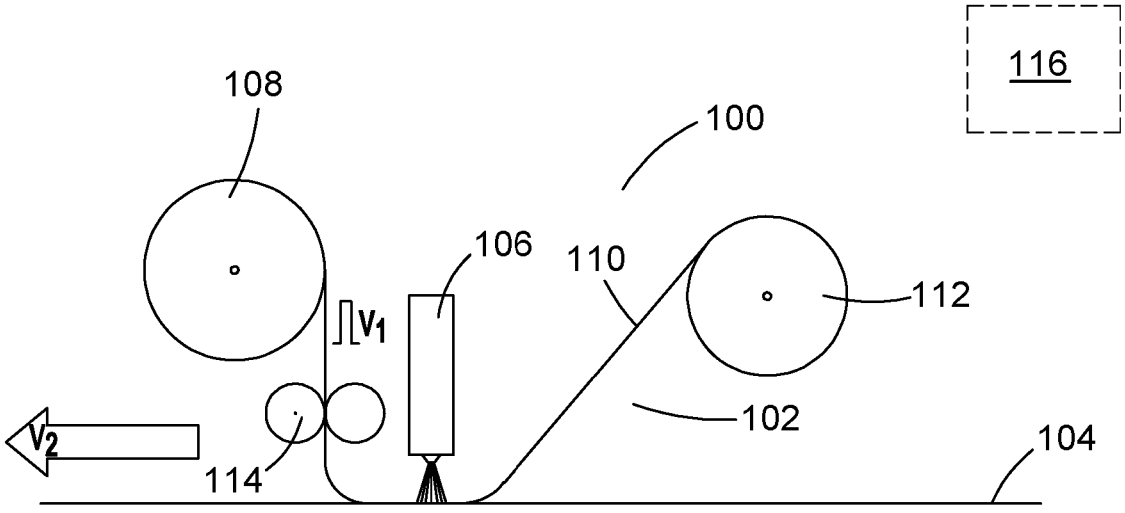
FIG. 2 illustrates a system for applying a masking material to a substrate according to a first aspect of the invention.

A first aspect of the invention 100 is illustrated in FIG. 2. A spray unit 102 is arranged such that it is spaced apart from a substrate 104 to be painted. The spray unit comprises a nozzle 106, a source feed 108 for dispensing a masking material 110, a waste deposit 112 for receiving used masking material 110 and a guide 114 for guiding the masking material 110 between the source feed and the waste deposit 112.

The source feed 108 and the waste deposit 112 are shown as rollers in the embodiment illustrated in FIG. 2. The masking material 110 is fed from the source feed 108 and applied to the substrate immediately before painting. Following painting, the masking material 110 is removed from the substrate 104 and stored in or on the waste disposal 112. One, or both, of the source feed 108 and waste deposit 112 rollers are driven by motors.

Figure 3:
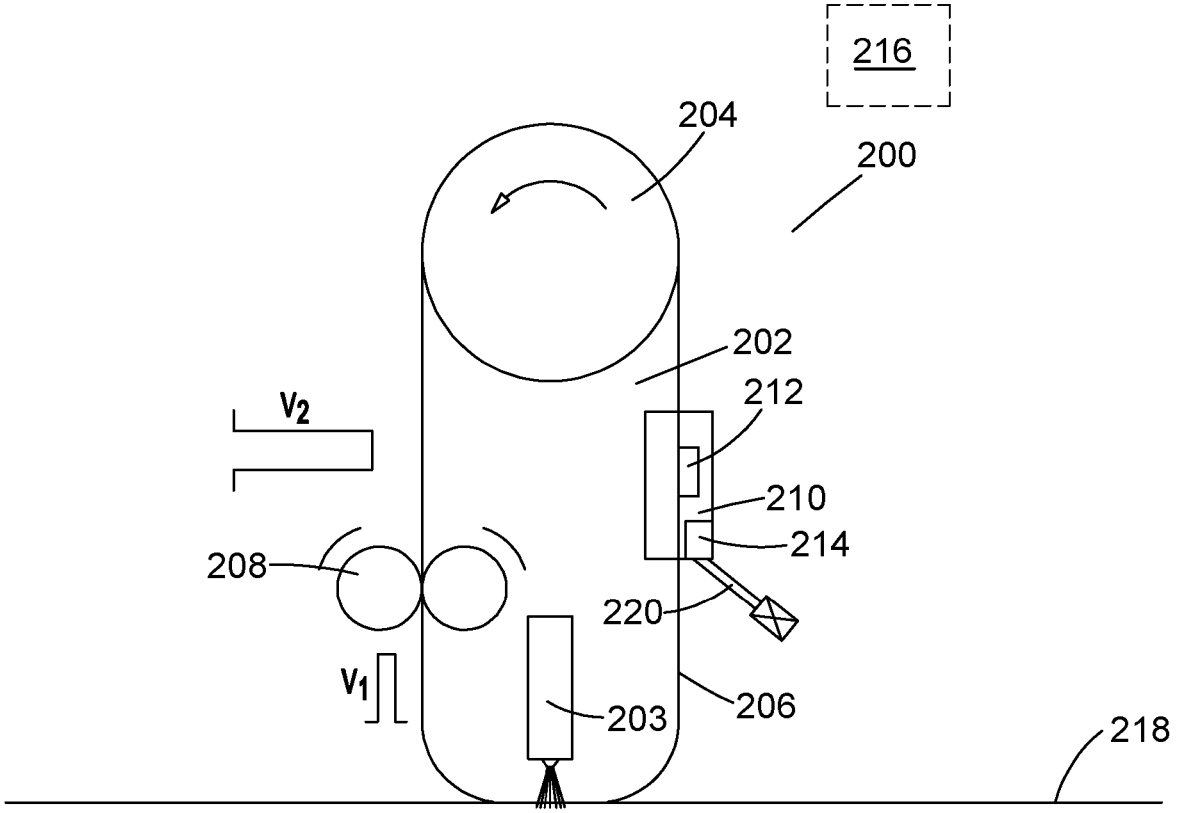
FIG. 3 illustrates a system for applying a masking material to a substrate according to a second embodiment of the invention.

The spray unit 102 is controlled by a controller 116 which is operable to control the linear movement of the spray unit 102 and transfer of the masking material 110 from the source feed 108 to the waste deposit 112. To facilitate effective operation of the spray unit 102, the controller 116 is configured such that the speed of transfer $V_1$ of the masking material 110 from the source feed 108 to the waste deposit 112 is equal to the speed of movement $V_2$ of the spray unit 102 relative to the substrate 104. As one or both of the source feed 108 and waste deposit 112 rollers are controllable by motor, the speed of the motors can be controlled as appropriate A second aspect of the invention 200 is illustrated in FIG. 3. A spray unit 202 comprises a nozzle 203, a roller 204 around which a continuous loop of masking material 206 is positioned. The masking material 206 is tensioned by one or more guides 208. A cleaning box 210 is provided in contact with the masking material 206. The cleaning box 210 comprises a wiper 212 for wiping paint medium from the masking material 206. The paint medium is collected in a reservoir 214 that is either part of the cleaning box 210 or external to the cleaning box 210. The reservoir 216 comprises a drain 220 to enable paint material within the reservoir 214 to be drained. The drain 220 comprises a valve 222 that has an open position in which paint material cannot be removed drained from the reservoir 214 and an open position in which paint material can be drained from the reservoir 214 through the drain 220.

To tension the continuous loop of masking material, a second roller (not shown) can be provided in-line with the first roller 204. Both the first roller 204 and second roller, if present, are offset from the nozzle 206.

The spray unit 202 is controlled by a controller 216 which is operable to control the movement of the spray unit 202 relative to the substrate 218 and movement of the continuous loop of masking material 206 around a looped path. To facilitate effective operation of the spray unit 202, the controller is configured such that the speed of movement $V_1$ of the masking material 206 around the path is equal to the linear movement $V_2$ of the spray unit 202.

In use, the continuous loop of masking material 206 is positioned against or close to a substrate 218 to be painted. As the spray unit 202 moves relative to the substrate 218, the masking material 206 moves around a pre-determined path. The masking material prevents paint medium from being applied to certain areas of the substrate 218.

Figure 4:
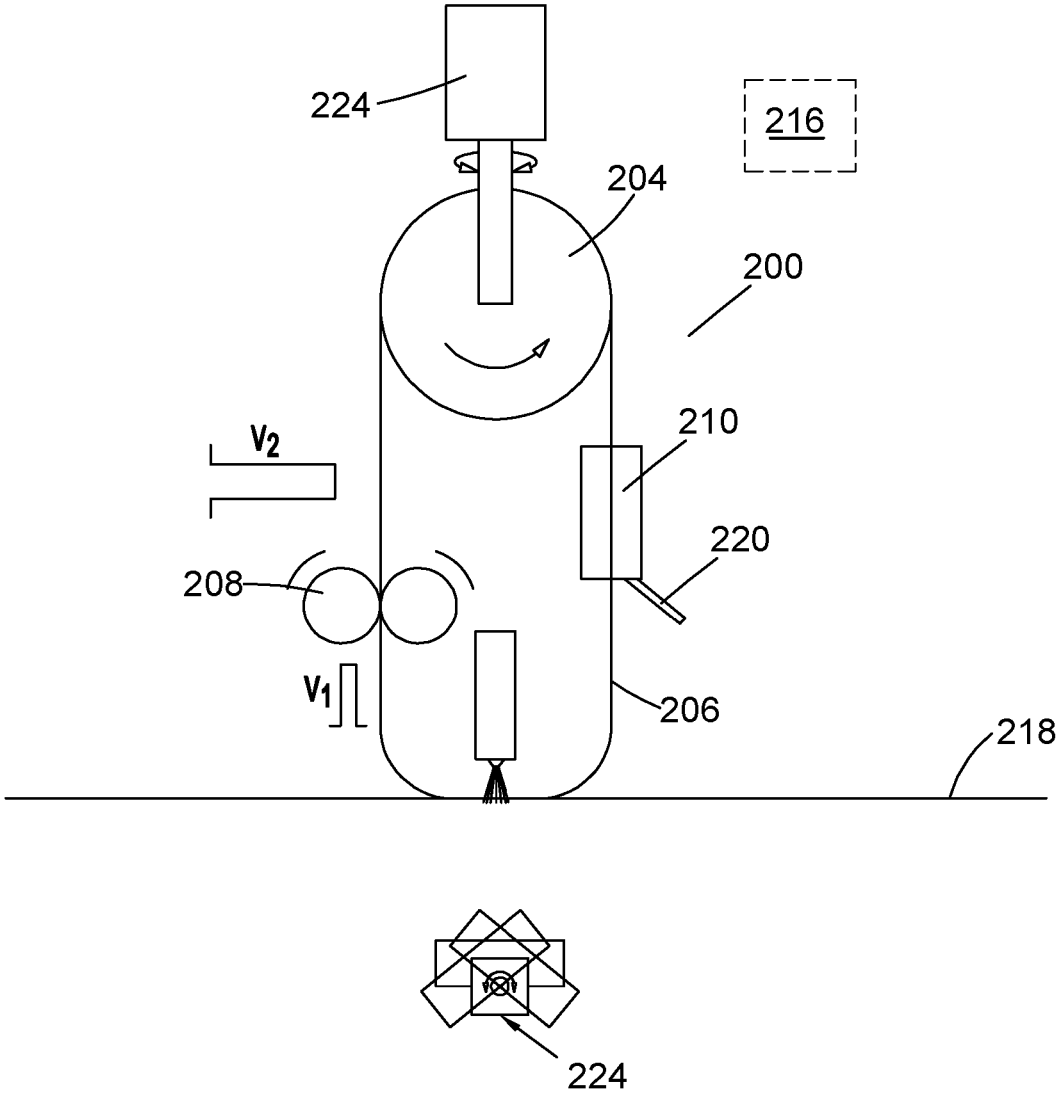
FIG. 4 illustrates a variation of the system of FIG. 3 that comprises an angle setting motor to enable the system to be used with curved surfaces.

FIG. 4 illustrates a spray unit 202 that further comprises an angle setting motor 224. The angle setting motor 224 enables axial rotation around a y-axis such that the angle of the first roller 204 can be adjusted. In one embodiment, the angle of the first roller 204 is controlled by the controller 216 such that angle setting motor 224 is instructed to adjust the angle of the first roller 204 in accordance with a change of direction of travel of the nozzle 203.

Figure 5:
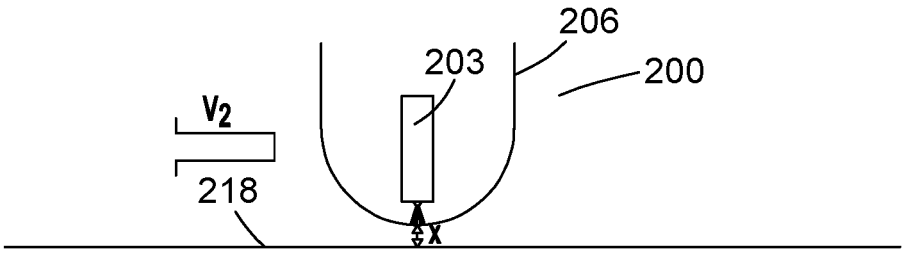
FIG. 5 illustrates another variation of the system of FIG. 3 that does not bring the masking material into contact with the substrate.

FIG. 5 illustrates a spray unit 202 that is configured such that the masking material 206 is not in contact with the substrate 218 during use. In this example, the masking material 206 is offset a distance x from the substrate 218. The first roller 204 is adjustable such that the distance of the first roller 204 relative to the substrate 218 is adjustable in height.

Figure 6:
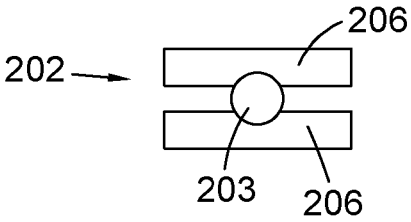
FIG. 6 illustrates another variation of the system of FIG. 3 that is arranged either side of the nozzle.

FIG. 6 illustrates a spray unit 202 that enables two continuous loops of masking material 206 to be applied against or close to the substrate 218. This can be achieved either through a roller design that can accommodate two loops of masking material 206. or through provision of two sets of rollers with each set of rollers accommodating respective loops of masking material 206. Each continuous loop of masking material 206 is delivered to the substrate 218 such that the nozzle 203 is positioned between the two continuous loops of masking material 206 on opposite sides of the nozzle 203.

The aforementioned description is intended to describe an embodiment of the invention and is given as an example only.

The invention claimed is:

1. A system for applying a paint medium to a substrate using a masking material, the system comprising:

a source feed for delivering a quantity of masking material close to the substrate, a waste deposit for receiving the masking material when removed from the substrate, a spray nozzle moveable relative to the substrate for applying the paint medium to the substrate, a cleaner arranged to clean excess paint medium from the masking material, and a controller configured to control movement of the spray nozzle relative to the substrate and the speed of delivery of the masking material close to the substrate from the source feed such that the speed of movement of the spray nozzle relative to the substrate is substantially equal to the speed of delivery of the masking material from the source feed.

2. The system according to claim 1, further comprising a spray unit defined at least in part by the source feed, waste deposit and spray nozzle, wherein the spray unit is controlled by the controller to be moveable relative to the substrate as a single unit.

3. The system according to claim 1, wherein the source feed comprises two rollers, each roller driving a respective continuous loop of masking material, wherein each continuous loop of masking material is configured to be applied to the substrate, one on each of opposite sides of the nozzle.

4. The system according to claims 3, wherein the source feed is configured to deliver the continuous loop of masking material such that the continuous loop of masking material is spaced apart from the substrate by a distance y.

5. The system according to claim 1, wherein the source feed comprises a roller.

6. The system according to claim 1, wherein the waste deposit comprises a roller.

7. The system according to claim 1, further comprising a guide for facilitating transfer of the masking material from the source feed to the waste deposit.

8. The system according to claim 7, wherein the guide comprises a pair of rollers spaced apart to contact either side of the masking material.

9. The system according to claim 8, wherein the pair of rollers is biased in an engaged position to contact the masking material and is moveable out of the engaged position to facilitate loading of the masking material.

10. The system according to claim 7, wherein the guide comprises at least two pairs of rollers, wherein a first pair of rollers is arranged between the source feed and the spray nozzle and a second pair of rollers is arranged between the spray nozzle and the waste deposit.

11. The system according to claim 1, further comprising angular adjustment means for modifying the angle of the source feed relative to the substrate.

12. The system according to claim 1, wherein the cleaner comprises a reservoir and at least one or more wiping blades.

13. The system according to claim 12, wherein the cleaner further comprises a drain for removal of paint material from the reservoir, wherein the drain comprises a valve having a closed position in which paint material cannot exit the reservoir and an open position in which paint material can exit the reservoir through the drain.

14. The system according to claim 12, wherein the cleaner comprises a level sensor for detecting the level of paint medium within the reservoir and the valve is controllable by the controller such that when the level of the paint medium within the reservoir is detected to have reached a pre-determined level by the level sensor the valve is moved to the open position to permit paint medium within the reservoir to drain therefrom.

15. The system according to claim 1, wherein the source feed comprises a roller configured to accommodate two respective continuous loops of masking material space apart to define a gap therebetween within which the nozzle is positioned, in use.

16. The system according to claim 15, wherein the source feed is configured to deliver the continuous loop of masking material such that the continuous loop of masking material is spaced apart from the substrate by a distance y.

* * * * *